United States Patent [19]

Birle

[11] 4,437,843

[45] Mar. 20, 1984

[54] DEVICE FOR SELF-ACTING LIMITATION OF SPEED OF ASCENDING DIVERS

[76] Inventor: Theo Birle, Quellenweg 11, 8531 Markt Erlbach, Fed. Rep. of Germany

[21] Appl. No.: 346,082

[22] PCT Filed: May 22, 1981

[86] PCT No.: PCT/DE81/00075

§ 371 Date: Jan. 22, 1982

§ 102(e) Date: Jan. 22, 1982

[87] PCT Pub. No.: WO81/03313

PCT Pub. Date: Nov. 26, 1981

[30] Foreign Application Priority Data

May 24, 1980 [DE] Fed. Rep. of Germany ..... 3019993
Jul. 24, 1980 [DE] Fed. Rep. of Germany ..... 3028070

[51] Int. Cl.[3] ..... B63C 9/12

[52] U.S. Cl. ..... 441/96; 114/315; 128/202.14

[58] Field of Search ..... 114/315, 331, 336; 441/96; 405/185; 128/200.28, 201.11, 201.27, 201.28

[56] References Cited

U.S. PATENT DOCUMENTS 4,051,846 10/1977 McClure ..... 128/202.14
4,176,418 12/1979 Scott ..... 128/202.14

*Primary Examiner*—Trygve M. Blix
*Assistant Examiner*—Jesús D. Sotelo
*Attorney, Agent, or Firm*—Jordan and Hamburg

[57] ABSTRACT

Apparatus for limiting the ascending speed of a diver in air-filled diving equipment includes a chamber and a separating device dividing the chamber into a first compartment and a second compartment. The first compartment is in communication with the inner space of the diving equipment, and a restriction is provided between the first and second compartments. A valve includes a valve seat cooperable with a closure member for opening and closing the valve, the valve being operably connected with the inner space of the diving equipment so that when the valve is open, the pressure within the inner space of the diving equipment is relieved to decrease the rate of ascent of the diver, the valve being opened when the pressure in the first compartment exceeds a value which is related to the passage of fluid through the restriction from the first compartment to the second compartment.

17 Claims, 4 Drawing Figures

DEVICE FOR SELF-ACTING LIMITATION OF SPEED OF ASCENDING DIVERS

BACKGROUND OF THE INVENTION

This invention relates to a device for self-acting limitation of the ascending speed of divers.

On ascending, air exposed to increased pressure within the alveoli of a diver cannot exit fast enough because of the large change of volume, with decreasing pressure, particularly in the range of −2 and −3 bar. When a part of the alveoli bursts, air enters the bloodstream in an undissolved state and through the left part of the heart, to the body, thus reaching the brain which might lead to an embolism of the brain.

At low over pressures in the lungs, the over extension of the alveoli may lead to disturbances of blood circulation and attacks of vertigo. Once a diver experiences an emergency, he must try, on the one hand, to ascend as fast as possible, but he must also also try, on the other hand, not to surpass a maximum ascending speed, depending on the actual depth, in order to prevent the aforementioned damages to his lungs. The rule of thumb, for instance, is to observe the speed of rise of small air bubbles which depends on the water pressure and thus the actual depth.

Various devices are already known which are utilized to aid a diver while ascending from deep water. Such a known device shows the diver whether a constantly predetermined speed of rise is being maintained, where the minimum rise speed, due to the depth-dependence of the maximum speed of rise, cannot be obtained as needed in an emergency. Another known, extremely expensive electronic device signals to the diver when a certain defined maximum speed of rise is surpassed. Such a signal is practically worthless when the diver is under the influence of an emergency and thereby not capable of regulating the rising process according to the signal, an actuality when the diver has lost consciousness.

Based on the above, the present invention has an objective to provide a device made simply and at a low cost, working under difficult conditions and remaining reliable, which under all circumstances, thus also in the case of extraordinary conditions, assures that the diver does not rise at too great a speed and thus be exposed to life-threatening or injurious conditions.

This objective is obtained by a device which is characterized by a chamber connected to the interior space of the diving suit, with a sealing separating partition that divides such chamber and is elastically and longitudinally movable. This separating partition is connected to a valve closure part leading outwardly and capable of being sealingly movable. An ancillary valve seat is disposed in the outer envelope of the diving suit while the chamber sections, created by the separating partition, are connected to each other by a metering valve and a check valve opening in the direction of the closed chamber section. When a diver dives down, the opened check valve and the metering valve create pressure compensation between the air pressure in the diving suit and its immediately connected chamber section, on the one hand, and the other chamber section on the other hand, through the check valve and the metering valve. Even when rising slowly, pressure compensation occurs between both chamber sections by aid of the metering valve. When rising too fast and uncontrolled, however, the air influx through the metering valve does not suffice to create pressure compensation. Due to the fact that air pressure within the diving suit and within the chamber section immediately connected to it decreases while rising due to decreasing water pressure and the expansion of the diving suit caused by it, reduced pressure arises relative to the closed chamber section.

The result of this under pressure is that the elastic separating partition is pressed downwardly and together with it the connected valve closure part, which is thereby lifted off the valve seat in the diving suit's outer mantle, so that air egresses outwardly from the diving suit through the valve opening, thereby automatically reducing the speed of rise until such a value of the speed of rise is obtained where pressure compensation may occur through the metering valve between the chamber segments so that the separating partition with the valve closure part returns again elastically to its starting position where the valve opening the diving suit is closed.

This automatic regulation ensures that the diver does not rise improperly, even when he is in a panic or when he is prevented by intensive vertigo or unconsciousness to consciously and intelligently control his rising process.

A preferred embodiment of the invention provides that the separating partition is formed as a spring-biased piston. According to the invention, such a piston is sealingly guided along the side wall of the chamber and is pressed by a spring into its starting position.

An advantageous development may provide that the check valve and the metering valve are arranged in the piston. That means that the piston has openings which accept the valve and the check valve, thereby obtaining a particularly simple construction.

According to another embodiment of the invention, the separating partition is formed by a flexible membrane and the valve closure part is fastened to the central area of the flexible membrane. The outer rim of the membrane is tightly and solidly connected to the wall of the chamber and the valve closure part is fastened to the membrane where maximum movement of the membrane occurs due to its elasticity when the membrane is under pressure. Re-adjustment of the membrane occurs without any problem due to the characteristic elasticity of the membrane. The two chamber segments formed by the membrane are connected by two conduits extending outwardly around the membrane area. One conduit includes the check valve and the other includes the metering valve.

It is particularly advantageous to provide the metering valve of the afore-described arrangement with a device for the regulation of the throughput. The metering valve, when manufactured, is so dimensioned that it allows at normal or permitted rising and diving speeds a sufficient pressure compensation between both chamber segments. Adjustment of the throughput of the metering valve is very advantageous in order to make the device of the invention subsequently adjustable in order to conform to momentary demands.

The possibilities of use of the device according to the invention are finally increased by coupling the movable separating partition with an indicating device. Thereby the diver can read on the indicating device whether his rising speed is in a critical area, in such cases when he is capable of consciously regulating the change of depth.

A particularly fatigue-resistant embodiment consists of a device which contains a first chamber, at least partly separated from the surrounding water by an elastic partition, and a second chamber with an enclosing, tight separating partition which is elastically and longitudinally movable, such separating partition being operably connected to a valve closure part whose ancillary valve seat is arranged in the outer mantle of the diving suit, while the first and the second chambers are connected by a metering valve.

The function of the elastic wall of the diving suit is taken over in this embodiment by the elastic partition of the first chamber which is capable of deformation by the pressure of the surrounding water and may be deformed by the influence of it, thereby leading to a change of pressure in the first chamber which, when occurring slowly, compensates or offsets the pressure in the second chamber through the metering valve. When the change of pressure in the first chamber occurs too fast, the throughput of the metering valve, which is adjusted to a predetermined maximum rising speed, does not suffice to effect pressure compensation in the second chamber through the metering valve. The amount of air contained in the second chamber presses therefore upon the separating partition which is longitudinally movable in one direction. It may be, for instance a membrane which is connected to the valve closure part. This causes opening of the diving suit valve and thus to a diminution of the speed of rise until the whole arrangement is again in pressure equilibrium.

In an additional embodiment of the invention, a particular advantage may be achieved by arranging the first and second chambers separate from each other and providing a connecting conduit between the chambers together with the metering valve. This makes it possible to obtain a very flat mode of construction.

The uses of the described device are not restricted to their use by divers but comprise diving equipment of all kinds, for example, submersible diving equipment for rescuing people from submarines or the like.

Additional characteristics, advantages and details of the invention will be seen from the following description of preferred embodiments as well as from the accompanying drawings.

DESCRIPTION OF THE PREFERRED EMBODIMENTS

Figure 1:
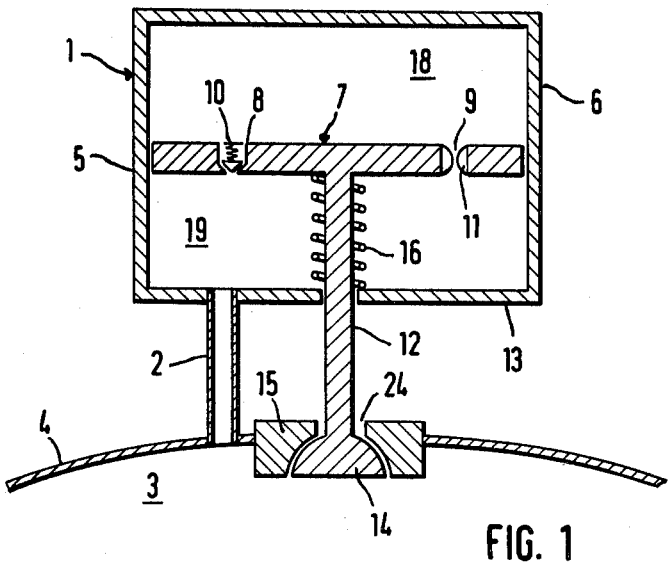
FIG. 1 is a schematic sectional view of a device according to a first embodiment of the invention.

In the embodiment shown in FIG. 1, a chamber 1 closed on the outside is connected by a connecting conduit 2 to the inner space 3 of a diving suit 4. In chamber 1, there is arranged a piston 7 that is movable along and seals tightly against the sidewalls 5, 6 of the chamber 1.

The piston has two openings 8 and 9, the first opening containing a check valve 10 and the second opening containing a restriction means or metering valve 11. Piston 7 is connected to a valve closure part 12, which extends sealingly outwardly through the bottom wall 13 of chamber 1 and which has a hemispherically thickened end 14. The end 14 abuts in its resting position a valve seat 15 which is fastened to the outer wall of the diving suit 4. A coil spring 16 is arranged concentrically around the valve closure part 12 between the chamber bottom 13 and the piston 7.

Figure 2:
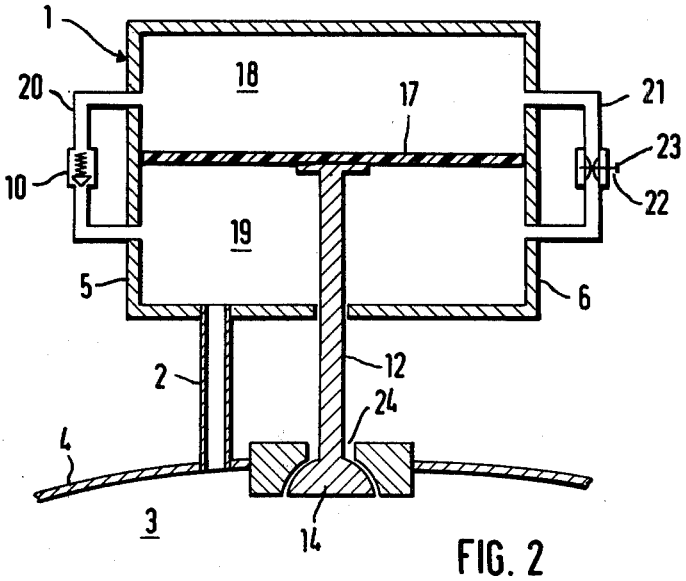
FIG. 2 is a schematic sectional view of a second embodiment.

In the embodiment shown in FIG. 2, again the chamber 1 is connected by a conduit 2 to the inner space 3 of the diving suit 4. Between the side walls 5 and 6 of chamber 1, a membrane 17 is tightly spanned and sealed. The valve closure part 12 is fastened to membrane 17. The chamber halves 18 and 19, formed by the membrane 17 which acts as a separating partition, are connected by conduits 20 and 21 which open either above or underneath membrane 17 into the interior of the chamber 1. A check valve 10 is disposed in conduit 20 and a metering valve 22 is disposed in conduit 21. The throughput of the metering valve 22 may be controlled by a control device 23.

Both devices function analogously as follows. On slow rising or diving, respectively, continuous pressure compensation takes place through conduit 2 or the metering valve 11, respectively between the air pressure in the interior space 3 of the diving suit 4, the chamber segment 19, and the chamber segment 18 which has no immediate connection to the diving suit 4. When diving quickly, for instance when jumping from a boat into the water, the check valve 10 opens, so that the separating partition 7 or 17, respectively remains substantially at a rest position or is possibly moved for a short period and is brought back immediately to its starting position.

Upon the diver rising, when a certain value of rising speed is exceeded, the diving suit 4 expands quickly due to the diminishing water pressure so that the air pressure in the inner space of the diving suit 4 and in chamber segment 19 lowers quickly, and this lowering cannot be compensated for by the metering valves 9 or 23, respectively. The underpressure in the chamber segment 19 occurring relative to chamber segment 18 moves the separating partition, the piston 7 or the membrane 17, respectively, together with the valve closure part 12 connected to it downwardly, so that air can pass outwardly through the valve aperture 24 from the diving suit inner space 3, thus reducing the buoyancy of the diving suit and thereby reducing the speed of rising of the diver.

Once this is achieved, the same pressure rises again after a short while in chamber segments 18 and 19 through metering valve 9 and 23, respectively, and the separating partition 7 or 17, together with the valve closure part 12, are brought back to the starting position. This occurs when piston 7 returns by the repositioning power of coil spring 16 and membrane 17 by its own elasticity.

Due to the fact that the air pressure in the diving suit depends each time on the depth, the point where valves 12, 14 are opened, in other words the maximum speed of rising becomes dependent on the depth, so that at each individual depth it is, on the one hand, assured that the maximum bearable speed is not exceeded but, on the other hand, that the entire length of rising is traversed in the shortest allowable time.

Figure 3:
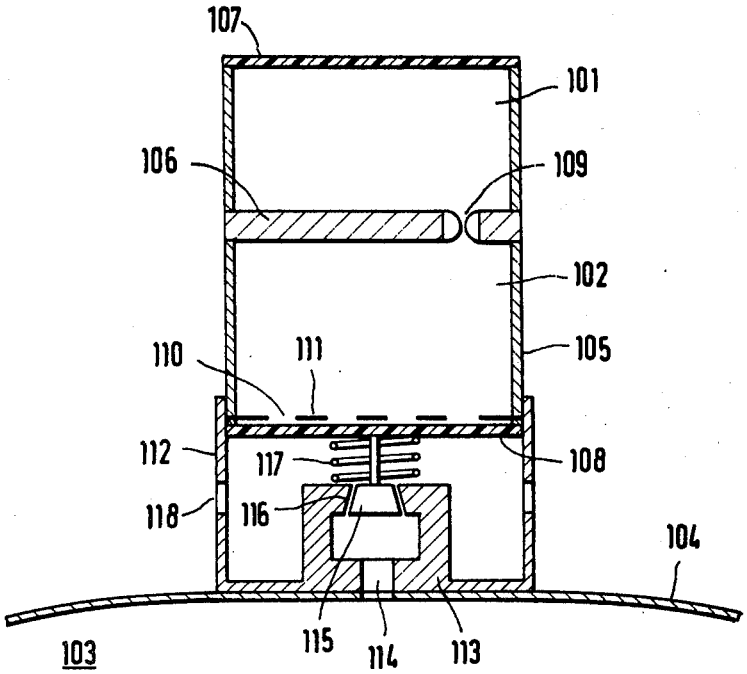
FIGS. 3 and 4 are schematic sectional views of a third and fourth embodiment respectively.

In another embodiment shown in FIG. 3, the device according to the invention includes two chambers 101 and 102 which are limited by a solid wall 105. A common partition 106 separates chambers 101 and 102. The upper chamber 101 is formed by a flexible membrane 107 which is sealingly fastened to lateral wall 105. Chamber 102 is closed at the bottom by flexible membrane 108, which is substantially movable outwardly, thus downwardly in FIG. 3, because it is held substantially in a plane position relative to the inner side of chamber 102 by a foraminous cover 111 which is provided with openings 110.

The common wall 105 of chambers 101 and 102 is connected to a mounting 112 which is connected with seals to the outer part 104 of the diving suit. The mounting 112 also includes a valve device 113 which is arranged upon an aperture 114 of the diving suit. At the ground level state, the valve closure part 115 is in a closed position seated on the valve seat 116. A helical spring 117 is disposed between the membrane 108 and the valve device 113 and thereby presses the valve closure part 115 into this closed position. Openings 118 in the mounting 112 allow the egress of air from the interior space 103 of the diving suit to the outside when valve 113 is open.

The device works as follows. When a diver is diving down, the pressure of water increases continuously, thereby increasing pressing membrane 107 towards the inside while membrane 108 is held substantially in its position by the foraminous wall 111. The metering valve 109 provides continuous compensation of pressure.

When ascending with sufficiently slow, danger-free speed, the elastic membrane 107 returns slowly to its starting position, shown in FIG. 3, thereby resulting in a reduction of the pressure of the volume of air enclosed in chamber 101. Thus the air, being at higher pressure at greater depths due to the pressure of water, streams through the metering valve 109 from chamber 102 to chamber 101. In this manner, the pressure in chamber 102 is reduced and membrane 108 remains substantially flat in its position. When ascending too fast, the throughput through the metering valve 109 does not suffice to cause pressure compensation, so that due to the still high air pressure in chamber 102 and the decreasing water pressure on the outside membrane 108 bulges outwardly which causes the valve closure part 115 to move off of the valve seat 116 and air is therefore able to escape from the inner space 103 of the diving suit outwardly through the opening 114 and the opening 118, thereby decreasing the speed of rising.

Once the speed of rising is diminished, pressure compensation can be obtained shortly thereafter through the metering valve 109, so that membrane 108 and with it the valve closure part 115 are pressed into their closed position by spring 117. This valve may be also formed as a check valve or as a one-way restrictor which is closed at a normal controlled emergency rise. Thus there is removed the possibly disadvantageous effect which may arise when a diver increases his rising speed with his flippers in a panic situation (the diving suit would be empty at the surface and a possibly unconscious diver could sink down due to the counter balancing effect). The spring pressure of the check valve or the one-way restrictor, respectively, must therefore be fixed at a predetermined limiting over pressure in chamber 102 as (occasionally only partial) pressure compensation occurs between chambers 101 and 102. Over pressure in chamber 102, though, could increase immediately again when rising and occasionally occurs too fast. Therefore, an erratic braked rise could occur, which is still within the frame of a medically allowed process. This arrangement is mainly advisable for emergency emergence from submarines at extreme depth and may be used by experienced personnel.

Figure 4:
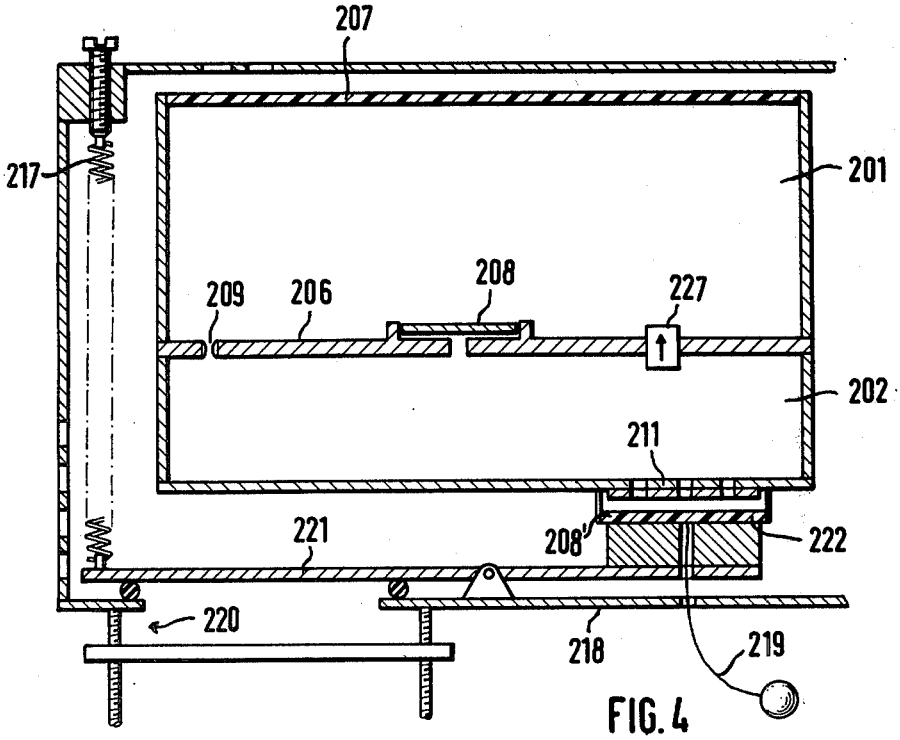

In the embodiment shown in FIG. 4, an excess pressure valve 227 and a valve 208 are arranged in a partition 206. Valve 208 serves to produce equilization of pressure between chambers 201 and 202 when the diver approaches the surface, for instance when the diver is five meters from the surface. Valve 208 functions as follows. Membrane 207 is subjected to the pressure of water. Meanwhile air passes through valve 209 and partly through valve 208 into chamber 202 and the area above membrane 208'. The membrane 208' does not collapse due to the presence of grid 211. Beginning at about 1 bar over pressure, the membrane 207 presses onto the closure part of valve 208 and keeps it shut. Above a predetermined over pressure, which is a function of the volume ratios of the chambers, the membrane 207 abuts the walls of chamber 201. When ascension occurs at a predetermined normal or acceptable rate, air passes from chamber 202 through valve 209 and beginning at a pressure of about 1 bar, through valve 208 back into chamber 201. Membrane 208', pressed down by spring 217, does not move. When ascension occurs too rapidly, air cannot stream back fast enough through valve 209, membrane 208' bulges, and presses by a rocker-like construction 218 the right arm (as shown in FIG. 4) of the rocker 221 downwardly so that air passes out of the buoyant body. Membrane 207 moves up, for instance at 0.5 bar over pressure, from valve 208 (because there is still a part of the air within chamber 202) and produces at once opening pressure compensation between chambers 201 and 202. The rocker arrangement 218 shuts at once. When ascension occurs too fast, membrane 207 presses still at up to 0.5 bar over pressure onto valve 208, because the pressure drop between chambers 201 and 202 at normal ascension is smaller than at fast ascension, in other words, valve 208 prevents bulging of membrane 208' in the case of only a small over pressure and the flap of the diving suit would be kept open for too long a time. This ensures that an unconscious diver is dept at the surface. The influence of over pressure upon the device depends on the elasticity of membrane 207, the size of the valve closure part of valve 208, the distance between membrane 207 and partition 206 and valve 208 and the ambient pressure. This may also be obtained by an over pressure valve 227 which is disposed between chambers 201 and 202 as regards the possibility of pulsating potential reaction. Spring 217 is capable of indirectly adjusting the throughput of valve 209. Greater spring power means greater pressure in chamber 202, in other words a larger flow through valve 209 because the difference of pressures in chambers 201 and 202 is larger than at small spring pressure. Accordingly, the device may be adapted to any individual diving process by being furnished with a comparatively large basic valve in which a large spring force results in blocking and a small spring force results in reacting also at normal speeds of ascent. In such an embodiment, there is furthermore provided a device 219 for manual service of the rocker device 218 as an emergency stop device, where the rocker device acts simultaneously as an over pressure device which prevents bursting of the diving suit.

This embodiment furthermore provides a distance between membrane 208' and the foraminous partition 211.

In this embodiment, the device according to the invention is screwed to the valve tap of the diving suit at 220 so that the valve closure part formed by the second lever part 221 of the rocker device 218 abuts tightly the inlet aperture or outlet aperture, respectively, of the diving suit.

In order to provide the valve 209 with such dimensions that the danger of icing is prevented, a preferred embodiment arranges a magnet 222 adjacent membrane 208' which is connected to a ferromagnetic metal plate or which is metallized. The magnet 222 holds membrane 208' and thereby the closure part 221 in closed position. Thereby the closure part 221 opens spontaneously once the magnetic holding force has been overcome by the self-regulating pressure difference. It is, of course, also within the invention to arrange the magnet 222 within the area of closure part 221.

I claim:

1. Apparatus for limiting the ascending speed of a diver in air-filled diving equipment comprising means defining a chamber, a separating means dividing said chamber into a first compartment and a second compartment, communicating means communicating said first compartment with the inner space of said diving equipment, said separating means being movable so as to provide variable volumes for said first and second compartments, a restriction means between said first and second compartments, a check valve between said first and second compartments, and a valve means comprising a closure member connected to said separating means and movable with said separating means, said valve means further comprising a valve seat cooperable with said closure member for opening and closing said valve means, said valve means being operably connected with the inner space of said diving equipment so that when said valve means is open, the pressure within the inner space of said diving equipment is relieved to decrease the rate of ascent of said diver, said valve means being opened when the pressure in said first compartment exceeds a value which is related to the passage of fluid through said restriction means from said first compartment to said second compartment.

2. Apparatus according to claim 1 wherein said separating means comprises a piston which is joined to said closure member, said valve means further comprising a spring means biasing said closure member toward a closed position.

3. Apparatus according to claim 2 wherein said restriction means and said check valve are arranged on said piston.

4. Apparatus according to claim 1 wherein said separating means is a flexible membrane separating said chamber into said first and second compartments, said closure member being secured to a central portion of said flexible membrane.

5. Apparatus according to claim 1 wherein said restriction means comprises an adjustable metering valve.

6. Apparatus according to claim 1 wherein said closure member sealingly extends externally of said chamber.

7. Apparatus according to claim 1 wherein said valve seat is mounted on said diving equipment about an opening which is in communication with the inner space of said diving equipment.

8. Apparatus according to claim 1 wherein said separating means and said valve means are constructed and arranged such that the amount of opening of said valve means is proportional to the position of said movable separating means in said chamber.

9. Apparatus for limiting the ascending speed of a diver in air-filled diving equipment comprising means defining a chamber, a separating means dividing said chamber into a first compartment and a second compartment, a restriction means between said first and second compartments, a first flexible means exposed to the pressure in said first compartment, a second flexible means defining a portion of said second compartment and being exposed to external ambient water pressure, a valve means providing communication with the inner space of said diving equipment and being movable to an open position to relieve the air pressure within the inner space of said diving equipment, and biasing means operatively associated with said first flexible means to open said valve means when said first flexible means expands said valve means being opened when the pressure in said first compartment exceeds a value which is related to the rate of ascent of said diver and to the passage of fluid through said restriction means from said first compartment to said second compartment.

10. Apparatus according to claim 9 wherein said valve means is mounted on said diving equipment about an opening which is in communication with the inner space of said diving equipment.

11. Apparatus according to claim 9 wherein said first and second compartments are disposed separately from each other, and said restriction means is a metering valve disposed in a connecting conduit between said first and second compartments.

12. Apparatus according to claim 9 wherein said first flexible means is a flexible membrane, and a magnetic material mounted on said flexible membrane, said valve means overcoming the magnetic force of said magnetic material upon opening of said valve means.

13. Apparatus according to claim 9 further comprising adjusting means for adjusting the biasing force with which said biasing means urges said valve means in its closed position.

14. Apparatus according to claim 9 further comprising a second valve means in said separating means, said second valve means being pressed into a closed position by said second flexible means.

15. Apparatus according to claim 9 further comprising a foraminous means for restraining flexure of said first flexible means in one direction.

16. Apparatus according to claim 9 wherein said biasing means comprises a coil spring which opposes the flexure of said first flexible means, the force of said coil spring being overcome to permit said first flexible means to flex and thereby open said valve means when the pressure in said first compartment exceeds a predetermined value which is related to the rate of ascent of said diving equipment.

17. Apparatus according to claim 9 further comprising linkage means between said first flexible means and said biasing means, said linkage means comprising a pivotal element, said pivotal element effecting opening and closing of said valve means.

* * * * *